United States Patent [19]

Ciesiel et al.

[11] 4,408,914

[45] Oct. 11, 1983

[54] PRINTER RIBBON CARTRIDGE MOUNTING ASSEMBLY

[75] Inventors: Allen R. Ciesiel, Arlington Heights; Richard E. LaSpesa; Ruperto B. Zolavvar, both of Chicago, all of Ill.

[73] Assignee: Teletype Corporation, Skokie, Ill.

[21] Appl. No.: 427,211

[22] Filed: Sep. 29, 1982

[51] Int. Cl.[3] ..... B41J 32/00; B41J 35/28

[52] U.S. Cl. ..... 400/208; 400/196; 400/247; 242/197; 248/27.3; 292/DIG. 38

[58] Field of Search ..... 400/196, 196.1, 207, 400/208, 247; 206/387; 242/197; 248/27.3; 292/DIG. 38; D14/11; 24/3 J, 293

[56] References Cited

U.S. PATENT DOCUMENTS 4,091,914 5/1978 Stipanuk ..... 400/208 X
4,130,367 12/1978 Guerrini et al. ..... 400/196 X
4,294,418 10/1981 Gell ..... 242/197
4,340,795 7/1982 Arthur ..... 248/27.3

FOREIGN PATENT DOCUMENTS 2443 6/1979 European Pat. Off. .... 292/DIG. 38

OTHER PUBLICATIONS

*IBM Technical Disclosure Bulletin*; "Cartridge Latching"; J.D. Treder; vol. 21, No. 8, pp. 3323–3324; Jan. 1979.

*Primary Examiner*—Edgar S. Burr
*Assistant Examiner*—David A. Wiecking
*Attorney, Agent, or Firm*—A. A. Tirva; J. C. Albrecht

[57] ABSTRACT

A printer ribbon cartridge mounting assembly includes a printer cartridge having a resilient cantilevered tab with a stepped surface which is arranged to push against a portion of a mounting bracket. The bracket also has an opening which accommodates a portion of the stepped surface, thereby locking the cartridge in place.

9 Claims, 4 Drawing Figures

PRINTER RIBBON CARTRIDGE MOUNTING ASSEMBLY

DESCRIPTION

1. Technical Field

This invention relates to printer ribbon cartridges, and more particularly, to a mounting assembly to secure a printer ribbon cartridge in a printer.

2. Background Art

Printer ribbon cartridges are well known and include many types of printer ribbon dispensing cartridges used in various types of impact printers. Cartridges are easy and relatively inexpensive to manufacture. For example, most of the cartridges in use are injection molded from plastics and are discarded after the ribbon is used up. However, most cartridges are used because of the convenience they offer. A well designed ribbon cartridge is easily and quickly installed in a printer without the need for an operator to come in contact with the ribbon, thus preventing the spreading of ink or other printing medium on operator's hands and clothing.

Along with the many types of available cartridges, just as many types of mounting and latching arrangements to secure the cartridges in the printers are utilized. For example, one cartridge manufacturer utilizes a magnetic latching arrangement wherein a permanent magnet is mounted on the printer and a metal plate is attached to the underside of the cartridge. Other cartridge manufacturers use various types of snap latches and locking tabs located on the printer. These mounting arrangements, while providing quick and easy mounting of cartridges in a printer, have several disadvantages. For example, the magnetic latching arrangement requires additional parts, such as a magnet and metal plate, and extra time for assembly. This increases the cost of the cartridge. The various types of snap latches and locking tabs which are usually located on the printer perform well initially, but after a while wear on the surfaces which mate with a cartridge, plus fatigue of the material which they are made-usually plastic or metal, may result in breakage of a latch or tab or in their failure to generate a sufficient force for proper latching.

DISCLOSURE OF THE INVENTION

In accordance with the present invention, we provide a mounting assembly for a printer ribbon cartridge wherein the cartridge has a housing with a pair of guide pins projecting from the bottom surface of the housing and additionally has a resilient cantilevered tab projecting from the bottom surface of the housing and extending past the top surface of the housing. An "L" shaped mounting bracket has a first surface with a pair of openings arranged to accommodate the guide pins and a second surface with an aperture arranged to accommodate a portion of the resilient tab. The resilient tab has a stepped surface which engages the second surface of the bracket when the guide pins are inserted into their respective openings. The resilient tab pushes against the second surface biasing the guide pins in their openings and a portion of the stepped surface enters into the aperture in the second surface locking the cartridge into place.

THE DRAWING

DETAILED DESCRIPTION

Figure 1:
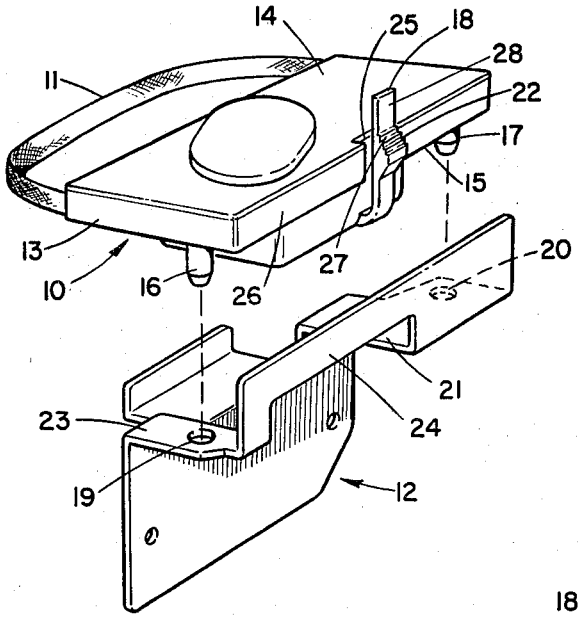
FIG. 1 is a perspective partially exploded view of a printer ribbon cartridge and a mounting bracket assembly in accordance with the invention.
Figure 2:
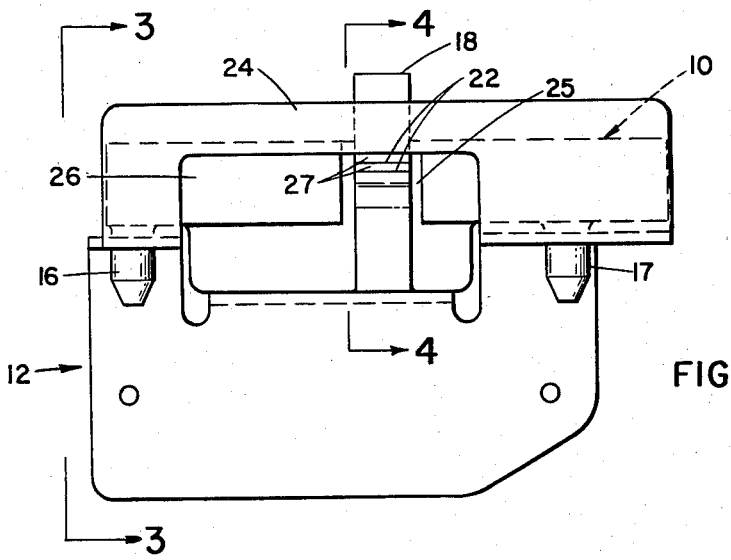
FIG. 2 is a front view of the printer ribbon cartridge assembly with the cartridge mounted on the mounting bracket.

As shown in FIGS. 1 and 2, a printer ribbon mounting assembly in accordance with the invention includes a cartridge 10 housing a printer ribbon 11, and a cartridge mounting bracket 12 which is normally affixed to a printer (not shown). The cartridge 10 has a substantially rectangular housing 13 having a top surface 14 and a bottom surface 15. A pair of guide pins 16 and 17 project from the bottom surface 15, and a resilient cantilevered tab 18 projects from the bottom surface 15 and extends upwards substantially parallel to a side 26 of the housing 13 and extends past the top surface 14 of the housing 13. The resilient tab 18 has a stepped surface 22 on a portion of its vertical surface 28 facing away from side 26. The stepped surface 22 includes a plurality of steps 27 originating on the substantially vertical surface 28 of the resilient tab 18 and extending out and downward for a portion of the vertical surface 28. The cartridge housing 13 has a recess 25 located in side 26 opposite resilient tab 18 arranged to accommodate a portion of the resilient tab 18. The housing 13, guide pins 16 and 17, and the resilient tab 18 may all be injection molded from a thermosetting type of plastic material.

The mounting bracket 12, which may be made from a sheet metal approximately 1/16" thick, has an "L" shaped portion which includes a first mounting surface 23 and a second mounting surface 24. The first mounting surface 23 has two openings 19 and 20 arranged to accommodate guide pins 16 and 17 respectively. The second mounting surface 24 has an aperture 21 arranged to accommodate a portion of the resilient tab 18.

Figure 4:
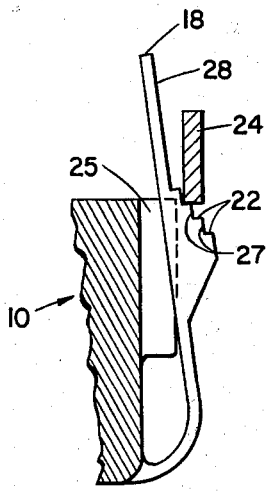
FIG. 4 is a sectional view of the assembly as shown generally along plane 4—4 of FIG. 2.
Figure 3:
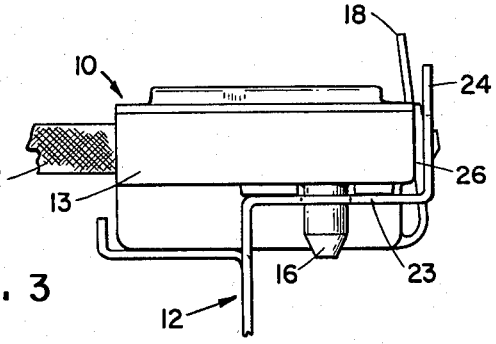
FIG. 3 is a sectional view of the assembly as shown generally along plane 3—3 of FIG. 2.

Referring now to FIGS. 2, 3, and 4, in the process of mounting the cartridge 10 on the mounting bracket 12, the guide pins 16 and 17 are inserted into openings 19 and 20, respectively, of the mounting bracket 12. The openings 19 and 20 are located on the first mounting surface 23, each a predetermined distance away from the second mounting surface 24 so that the surface 24 does not interfere with the mounting of the cartridge housing 13 on the bracket 12.

A downward force applied to the cartridge 10 forces the pins 16 and 17 into their respective openings 19 and 20 until the bottom surface 15 of the cartridge 10 makes contact with the first mounting surface 23. At the same time, the resilient tab 18, and specifically, the stepped surface 22 located on tab 18 contacts the second mounting surface 24. The second mounting surface 24 pushes the resilient tab 18 back towards the cartridge 10 and partially into the recess 25. Simultaneously, a portion of the stepped surface 22 on the resilient tab 18 enters aperture 21 located in the second mounting surface 24. The resultant force developed by the resilient tab 18 by being pushed back into the recess 25, biases the guide pins 16 and 17 in their respective openings 19 and 20, and keeps a portion of the stepped surface 22 in the aperture 21 thus locking the cartridge 10 in place by preventing lateral and vertical movement.

To remove the cartridge 10 from the mounting bracket 12, a force is applied to the top portion of the resilient tab 18 forcing tab 18 into recess 25 allowing the stepped surface 22 to exit completely from aperture 21. Once the stepped surface 22 is out of the aperture 21 and out of contact with the second mounting surface 24, the cartridge 10 can be removed from the mounting bracket 12.

What is claimed is:

1. A printer ribbon cartridge mounting assembly comprising:

a printer ribbon cartridge housing arranged to house a printer ribbon;

a pair of guide pins projecting from the bottom surface of the housing;

a resilient cantilevered tab projecting from the bottom surface of the housing and extending substantially parallel to a side of the housing and past the top surface of the housing;

a mounting bracket having a pair of openings arranged to accommodate the guide pins and further having an aperture arranged to accommodate a portion of the resilient tab; and an uneven surface located on the resilient tab, a portion of the uneven surface arranged to enter the aperture and engage the bracket when the guide pins are inserted into their respective openings thereby locking the housing to the bracket.

2. Printer ribbon cartridge mounting assembly in accordance with claim 1 further comprising means for releasing the housing from the mounting bracket.

3. Printer ribbon cartridge mounting assembly in accordance with claim 2 wherein the releasing means includes a recess located in the side of the housing opposite the resilient tab, the recess arranged to accommodate a portion of the resilient tab when a force is applied to the top of the tab to remove the stepped surface from the aperture.

4. Printer ribbon cartridge mounting assembly in accordance with claim 1 wherein the uneven surface comprises a plurality of steps.

5. A printer ribbon cartridge mounting assembly comprising:

a printer ribbon cartridge housing arranged to house a printer ribbon;

a pair of guide pins projecting from the bottom surface of the housing;

a resilient cantilevered tab projecting from the bottom surface of the housing and extending substantially parallel to a side of the housing and past the top surface of the housing;

a mounting bracket having a substantially "L" shaped portion, the portion having a first and a second mounting surface, the first mounting surface having two openings arranged to accommodate the guide pins and the second surface having an aperture arranged to accommodate a portion of the resilient tab; and a stepped surface located on the resilient tab arranged to engage the second mounting surface of the bracket when the guide pins are inserted into their respective openings and a portion of the resilient tab enters the aperture on the second mounting surface, wherein the resilient tab pushes against the second mounting surface biasing the guide pins in their openings and a portion of the stepped surface in the aperture locks the housing in place.

6. Printer ribbon cartridge mounting assembly in accordance with claim 5 wherein each of the guide pins are located closer to the side of the housing with the resilient tab.

7. Printer ribbon cartridge mounting assembly in accordance with claim 6 wherein the distance from the center of each guide pin to the side of the housing with the resilient tab is less than the distance from the center of the respective opening for each guide pin located in the first mounting surface to the second mounting surface.

8. Printer ribbon cartridge mounting assembly in accordance with claim 5 wherein the cartridge housing has a recess in the side opposite the resilient tab arranged to accommodate a portion of the resilient tab.

9. Printer ribbon cartridge mounting assembly in accordance with claim 5 wherein the stepped surface has a plurality of steps originating on the substantially vertical surface of the resilient tab, the steps extending away and in a downward direction for a portion of the vertical surface of the tab.

* * * * *